United States Patent [19]

Palau

[11] Patent Number: 4,541,459

[45] Date of Patent: Sep. 17, 1985

[54] HOOKING DEVICE FOR THE SEMI-AUTOMATIC CONNECTION OF THE HEDDLE FRAMES OF WEAVING LOOMS WITH THE LEVERS FOR CONTROLLING THEM

[75] Inventor: Joseph Palau, Saint Jorioz, France

[73] Assignee: S.A. Des Etablissements Staubli (France), Faverges, France

[21] Appl. No.: 578,385

[22] Filed: Feb. 8, 1984

[30] Foreign Application Priority Data

Feb. 16, 1983 [FR] France ..... 83 02733

[51] Int. Cl.[4] ..... D0C3 13/00

[52] U.S. Cl. ..... 139/88

[58] Field of Search ..... 139/57, 58, 81, 82, 139/84; 24/241 R; 403/206

[56] References Cited

U.S. PATENT DOCUMENTS 4,365,653 12/1982 Freisler et al. ..... 139/88

4,378,819 4/1983 Macho ..... 139/88

FOREIGN PATENT DOCUMENTS 2813169 6/1980 Fed. Rep. of Germany ..... 139/88

*Primary Examiner*—Henry S. Jaudon

*Attorney, Agent, or Firm*—Dowell & Dowell

[57] ABSTRACT

The present invention relates to a hooking device for the semi-automatic connection of the heddle frames of weaving looms with the levers for controlling them. A locking ring is rotatably mounted and has a hexagonal or octogonal profile so that, once correctly oriented by abutment against a ramp, it is closely applied against corresponding bearing surfaces made in the opening of the opposed hook.

1 Claim, 3 Drawing Figures

HOOKING DEVICE FOR THE SEMI-AUTOMATIC CONNECTION OF THE HEDDLE FRAMES OF WEAVING LOOMS WITH THE LEVERS FOR CONTROLLING THEM

The present invention relates to the heddle frames associated with the dobbies and other systems which, in weaving looms, achieve the formation of the shed, and it relates more particularly to the connecting devices interposed between these frames and the levers for controlling said dobbies or systems.

It is known that, with a view to simplifying the operations of assembly and dismounting of the heddle frames, connecting devices have been proposed which are adapted to ensure, virtually automatically (i.e. with the aid of a single motion), the hooking and unhooking of the assembly of frames and levers. The devices of this type, particularly the one described in Swiss Pat. No. 545 871 filed Dec. 14, 1971 in the name of STAUBLI AG, generally comprise a laterally open hook provided at the end of each of the levers and adapted, against angular displacement of the latter, to come into engagement on a locking rod fixed on the crosspiece of the frame in question. A loaded retaining member opposing any untimely disengagement, is capable of being momentarily retracted with a view to unhooking the parts.

Experience has shown that, although the devices of this type are satisfactory from the functional standpoint, the considerable and repeated forces to which they are subjected during the incessant reciprocating movement of the heddle frams, cause a relatively rapid wear of the hooking parts. Such wear leads to the appearance of a considerable clearance in the connection, which clearance may be accompanied by an increase in the noise and by undesirable vibratory phenomena.

Furthermore, it occurs that the hooking operation is frequently defeated by a transverse and/or angular offset between certain of the hooks and the corresponding locking rods. In such a case, manual intervention is necessary, which, of course, eliminates the advantages of the automatic connecting system.

It is the principal object of the invention to overcome these drawbacks, essentially by replacing the fixed locking rod by a rotating ring having a regular polygonal profile with six or eight sides, and by providing in the opening of each hook improved bearing surfaces adapted to cooperate with the polygonal cross section of the ring which thus fits without clearance in said opening.

It will be readily appreciated that such an arrangement ensures, on the one hand, an improved distribution of the forces as a result of the increase in the surfaces in contact, which obviously retards the appearance of wear, and, on the other hand, provides an automatic adjustment of this clearance under the effect of the thrust exerted laterally by the retaining member, advantageously provided in the form of a pivoting pawl with elastic return.

The invention will be more readily understood on reading the following description with reference to the accompanying drawings, in which.

Figure 1:
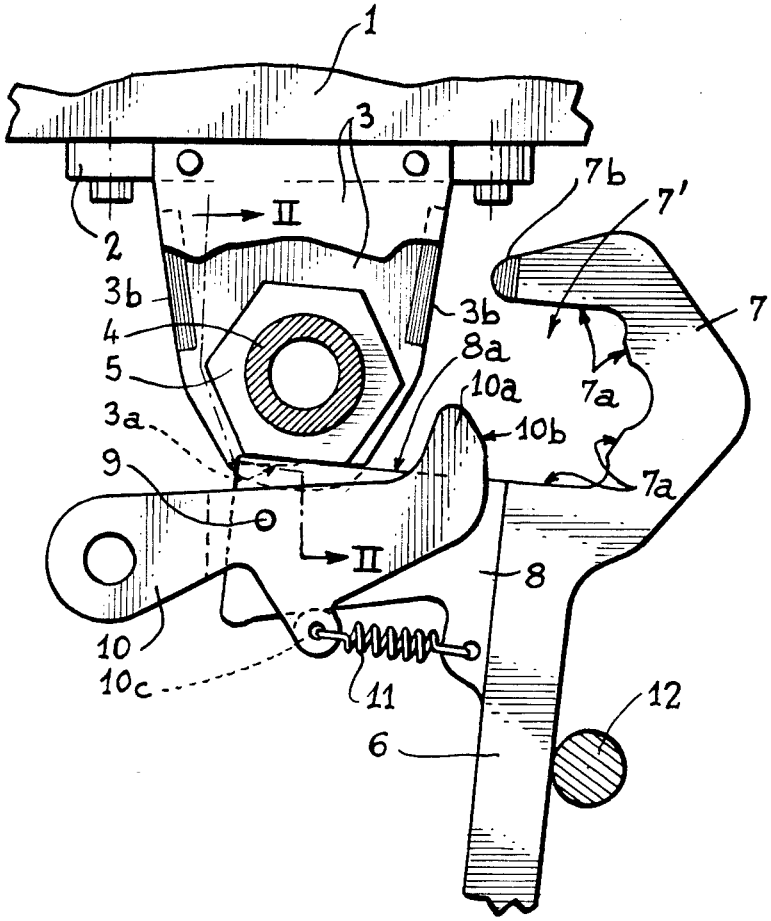
FIG. 1 is a side view, with parts broken away, showing the arrangement of one of the elements of a hooking device according to the invention, the parts being shown in open position prior to hooking.

Referring now to the drawings, reference 1 designates the lower crosspiece of a conventional heddle frame, against which crosspiece is fixed a horizontal bar 2 carrying two cheeks 3 which extend vertically downwardly. These two cheeks 3 are connected in the vicinity of their lower part by a transverse pin 4 on which a locking ring 5, whose periphery is of hexagonal profile, freely rotates.

Furthermore, reference 6 represents the upper end of one of the levers for vertical control of the heddle frames. In conventional manner, the top of this lever 6 is in the form of a hook 7 laterally open in the direction of the ring 5. However, it should be observed that the edge of the hook 7 which defines the opening 7' thereof comprises four flat bearing surfaces **7*a*, oriented at 60° with respect to one another so as to correspond to the hexagonal profile of the ring 5. It will further be noted that the hook 7 supports a lateral heel 8 disposed in front of the opening 7' and of reduced thickness with respect to that of the hook; the upper edge of this heel 8 is in line with the lower bearing surface 7*a* of the opening 7' of the hook 7, so as to constitute a ramp 8*a***, as will be more readily understood hereinafter.

The heel 8 bears a transverse pin 9 on the projecting ends of which pivot the two cheeks of an overlapping pawl 10 associated with a return spring 11. This spring continuously tends to make the pawl 10 pivot in one direction such that its nose element **10*a* projects in front of the opening 7' of the hook 7, and it will be noted that this nose element 10*a* includes an oblique bearing surface 10*b*. The angular displacement of the loaded pawl 10 under the effect of the spring 11 is limited by an inner stop 10*c***.

Figure 3:
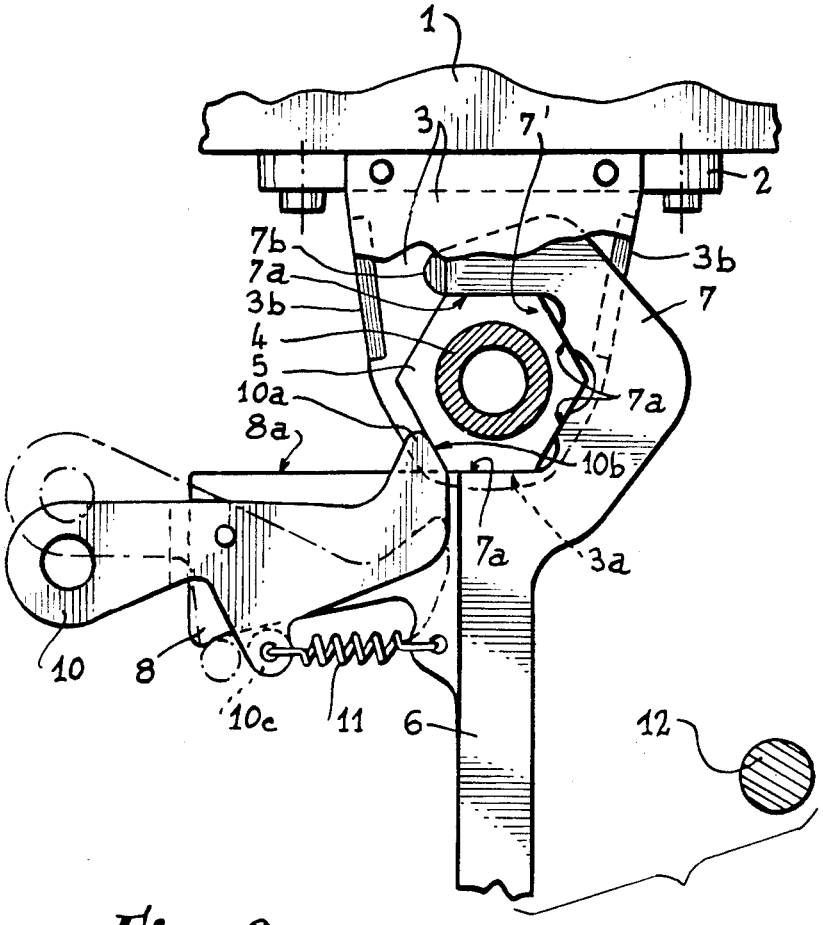
FIG. 3 shows the device of FIG. 1 in closed position after hooking.

Operation of the above-described assembly follows from the foregoing explanations and from an examination of FIGS. 1 and 3 of the drawings, and it is therefore easily understood.

In unhooked position, the control levers 6 of the dobby are oriented obliquely, abutting against a fixed stop 12 (FIG. 1) oriented parallel to the pivot axis of said levers. When the heddle frame assembly is positioned on the weaving loom, each of the pairs of cheeks 3 borne by said frames overlaps the heel 8 of the hook 7 of the corresponding lever 6. It will be noted that, in order to facilitating this engagement, the above-mentioned cheeks extend beyond the profile of the ring 5, such extensions being bevelled at **3*a*. It will further be observed that, during positioning of the frames, the rotating rings 5 come into abutment against the ramps 8*a* of the heels 8 of the hooks 7, so that, whatever the initial orientation of these rings, one side of their hexagonal profile bears flat on the ramp 8*a* as illustrated, due to their freedom of angular displacement on their pin 4**.

Under these conditions, it is appreciated that the hooking of the assembly of heddle frames requires only the pivoting of the control levers 6. As illustrated in FIG. 3, each hook 7 embraces the ring 5 which corresponds thereto, the flat bearing surfaces **7*a* applying against four sides of the profile of said ring. The latter is therefore received perfectly in the opening 7'**.

During engagement of each ring 5 in opening 7' of the hook 7 in question, the pawl 10 is momentarily retracted by pivoting due to the fact that the ring 5 struck the outer edge of the nose element 10*a*. On the other hand, as soon as the ring 5 is housed in the opening 7′, this pawl 10 pivots in opposite direction under the effect of spring 11, so that its oblique bearing surface 10*b* is applied against one of the six sides of the hexagonal profile of said ring, which consequently receives a thrust effect which maintains it without clearance in opening 7′. At that moment, the ring 5 is maintained by contact on five of the six sides of its profile and it will be understood that this hold obviously ensures a perfect guiding which reduces wear and the developing of the clearance, it being observed that this clearance is automatically adjusted by the loaded pawl 10.

Figure 2:
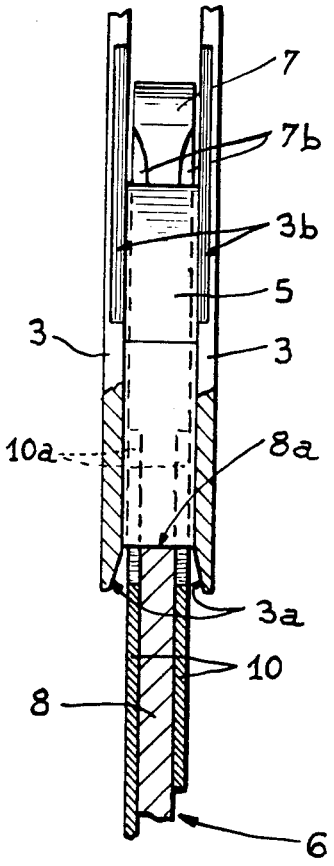
FIG. 2 is a vertical section in detail, to a larger scale, substantially along the plane indicated at II—II in FIG. 1.

With a view to facilitating engagement of each hook 7 between the two corresponding cheeks 3, the latter are advantageously bevelled at 3*b* (FIG. 2), at the same time as the end of said hook is tapered at 7*b*. This arrangement, combined with the precise positioning of the hooks 7 ensured by the permanent engagement of the thinned heels 8 between the cheeks 3, avoids any risk of untimely blockage of the levers 6 as a result of a transverse offset.

Unhooking of the levers 6 simply involves retracting the pawls 10 by momentary raising of their end opposite nose element 10*a*. As shown in broken lines in FIG. 3, this raising releases the rings 5, so that the hooks 7 may then be laterally retracted by pivoting, thus returning to the unhooked position illustrated in FIG. 1.

It should be observed that functioning which is almost as satisfactory may be obtained with rings of octogonal profile, the opening 7′ of the hooks 7 obviously being shaped accordingly.

It must, moreover, be understood that the foregoing description has been given only by way of example and it in no way limits the domain of the invention which would not be exceeded by replacing the details of execution described by any other equivalents. In particular, the above-described arrangement may be reversed, in that the hooks 7 with their heel 8 and their loaded pawl 10 may be fixed below the lower crosspieces 1 of the heddle frames, and a rotating ring 5 of polygonal profile may be fixed laterally on each of the control levers 6.

What is claimed is:

1. In a weaving loom, an improved device for the semiautomatic connection of a heddle frame element with a lever element for controlling it, the device comprising:

a pair of parallel spaced cheeks extending from one element toward the other element and having a pivot pin extending between the cheeks;

a locking ring rotatably supported by said pin between said cheeks, the locking ring having polygonally disposed outer surfaces, and the cheeks extending beyond said outer surfaces toward the other element;

a hook on the other element pivotable between a closed position in which the hook connects with the ring and an open position away from the ring, the hook having an opening shaped to receive the ring in said closed position and having bearing surfaces within the opening shaped to engage outer surfaces of the ring, and the hook having a heel member extending from the hook and between the cheeks in said open position and lying against one of the polygonal surfaces of the ring; and releasable spring-loaded retaining means carried by the hook and operative to engage the ring and hold said bearing surfaces against said polygonal surfaces in said closed position.

* * * * *